US010676698B2

(12) United States Patent
Batchelor et al.

(10) Patent No.: US 10,676,698 B2
(45) Date of Patent: Jun. 9, 2020

(54) LAUNDRY DETERGENT COMPOSITION COMPRISING AN ALKYL ETHER CARBOXYLIC ACID/LIPID ESTERASE COMBINATION

(71) Applicant: Conopco, Inc., Englewood Cliffs, NJ (US)

(72) Inventors: Stephen Norman Batchelor, Chester (GB); Jayne Michelle Bird, Ellesmere Port (GB)

(73) Assignee: Conopco, Inc., Englewood Cliffs, NJ (US)

( * ) Notice: Subject to any disclaimer, the term of this patent is extended or adjusted under 35 U.S.C. 154(b) by 155 days.

(21) Appl. No.: 15/578,517

(22) PCT Filed: May 25, 2016

(86) PCT No.: PCT/EP2016/061831
§ 371 (c)(1),
(2) Date: Nov. 30, 2017

(87) PCT Pub. No.: WO2016/198263
PCT Pub. Date: Dec. 15, 2016

(65) Prior Publication Data

US 2018/0155657 A1 Jun. 7, 2018

(30) Foreign Application Priority Data

Jun. 11, 2015 (EP) ..... 15171686

(51) Int. Cl.

| | |
|---|---|
| ***C11D 1/06*** | (2006.01) |
| ***C11D 3/386*** | (2006.01) |
| ***C11D 1/37*** | (2006.01) |
| ***C11D 10/04*** | (2006.01) |
| *C11D 1/22* | (2006.01) |
| *C11D 1/14* | (2006.01) |
| *C11D 1/28* | (2006.01) |
| *C11D 1/29* | (2006.01) |

(52) U.S. Cl.
CPC ..... *C11D 3/38627* (2013.01); *C11D 1/37* (2013.01); *C11D 10/042* (2013.01); *C11D 1/06* (2013.01); *C11D 1/146* (2013.01); *C11D 1/22* (2013.01); *C11D 1/28* (2013.01); *C11D 1/29* (2013.01)

(58) Field of Classification Search
CPC .... C11D 1/06; C11D 1/22; C11D 1/37; C11D 3/38627
See application file for complete search history.

(56) References Cited

U.S. PATENT DOCUMENTS

| | | | | |
|---|---|---|---|---|
| 6,060,441 | A | 5/2000 | Hessel | |
| 6,376,445 | B1 | 4/2002 | Bettiol et al. | |
| 6,630,439 | B1 * | 10/2003 | Norwood | C11D 3/10 510/392 |
| 6,897,188 | B2 | 5/2005 | Gohl et al. | |
| 8,586,521 | B2 | 11/2013 | Brooker et al. | |
| 2002/0102702 | A1 | 8/2002 | Osten et al. | |
| 2003/0171249 | A1 | 9/2003 | Lang | |
| 2006/0115440 | A1 * | 6/2006 | Arata | A61K 8/19 424/65 |
| 2006/0122093 | A1 | 6/2006 | Permejo | |
| 2012/0151684 | A1 | 6/2012 | Brooker | |
| 2014/0230156 | A1 * | 8/2014 | Lant | C11D 1/62 8/137 |
| 2018/0100127 | A1 | 4/2018 | Batchelor | |
| 2018/0155657 | A1 | 6/2018 | Batchelor | |
| 2018/0346845 | A1 | 12/2018 | Batchelor | |

FOREIGN PATENT DOCUMENTS

| | | |
|---|---|---|
| CN | 1276055 | 12/2000 |
| CN | 1533426 | 9/2004 |
| CN | 101072859 | 11/2007 |
| CN | 103975050 | 8/2014 |
| CN | 130975049 | 8/2014 |
| DE | 3320340 | 12/1983 |
| WO | WO9845396 | 10/1998 |
| WO | WO2013087284 | 6/2013 |
| WO | WO2013087286 | 6/2013 |
| WO | WO2014060235 | 4/2014 |

OTHER PUBLICATIONS

IPRP2 in PCTEP2016061823, Sep. 21, 2017.
IPRP2 in PCTEP2016061831, Sep. 29, 2017.
Search Report and Written Opinion in EP15171686, dated Dec. 18, 2015.
Search Report and Written Opinion in PCTEP2016061823, dated Aug. 26, 2016.
Search Report and Written Opinion in PCTEP2016061831, dated Aug. 26, 2016.
Search Report in EP15171685, dated Dec. 10, 2015.
Written Opinion 2 in PCTEP2016061823, dated May 11, 20017.
Written Opinion 2 in PCTEP2016061831, dated May 11, 2017
Written Opinion in EP15171685, dated Dec. 10, 2015
Co-Pending U.S. Appl. No. 15/578,499; Applicant: Stephen Norman Batchelor, filed Nov. 30, 2017.

* cited by examiner

*Primary Examiner* — Charles I Boyer
(74) *Attorney, Agent, or Firm* — Greenberg Traurig, LLP

(57) ABSTRACT

The present invention provides a domestic laundry cleaning composition, said composition comprising an anionic surfactant, an alkyl ether carboxylic acid dispersant; and a lipid esterase.

9 Claims, No Drawings

LAUNDRY DETERGENT COMPOSITION COMPRISING AN ALKYL ETHER CARBOXYLIC ACID/LIPID ESTERASE COMBINATION

FIELD OF INVENTION

The present invention concerns the use of specific alkyl ether carboxylic acids with a lipid esterase in a detergent formulation.

BACKGROUND OF THE INVENTION

Lipid esterase are enzymes that hydrolyse the ester bonds in a lipid. They can be produced by a large number of living cells for example bacteria, yeasts and fungi. In the laundry context cleaning lipid esterase are well-known which enhance the cleaning of fabrics. Examples of cleaning lipid esterases include first wash lipases.

Lipid esterases are discussed in Enzymes in Detergency edited by Jan H. Van Ee, Onno Misset and Erik J. Baas (1997 Marcel Dekker, New York).

There is a need to improve the performance of cleaning lipid esterase enzymes in detergent formulations.

WO2013/087286 (Unilever) discloses liquids formulations containing alkyl ether carboxylic acids, betaines, anionic surfactant, non-ionic surfactant for providing softening benefits.

WO2014/060235 discloses a laundry detergent composition comprising (a) nonionic surfactant, (b) anionic surfactant, (c) alkyl ether carboxylic acid or carboxylate salt thereof, and, (d) a polyglucosamine or a copolymer of glucosamine and N-acetylglucosamine; and to its use to soften fabrics.

US 2006/122093 discloses laundry detergent composition containing from about 1 percent to about 80 percent of a surfactant system, a mixed builder system, and the balance adjunct ingredients. The mixed builder system contains from about 0.1 percent to about 40 percent phosphate builder and from about 0.1 percent to about 40 percent of a non-phosphate builder.

During use the concentration of the non-phosphate builder in the wash liquor is from about 240 ppm to about 3,600 ppm and the weight ratio of the phosphate builder to the non-phosphate builder in the wash liquor is from about 1:10 to about 10:1.

SUMMARY OF THE INVENTION

None of the aforementioned documents disclose a synergy between the combination of a lipid esterase and specific alkyl ether carboxylic acids.

We have found that the combination of a lipid esterase and specific alkyl ether carboxylic acid gives enhanced cleaning.

In one aspect the present invention provides a laundry detergent composition comprising:

(i) from 4 to 50 wt % of an anionic surfactant, preferably the level of anionic surfactant is from 6 to 30 wt %, more preferably from 8 to 20 wt %;

(ii) from 0.5 to 20 wt %, preferably from 2 to 14 wt %, most preferably from 2.5 to 5 wt % of an alkyl ether carboxylic acid dispersant of the following structure:

$$R—(OCH_2CH_2)_n—OCH_2—COOH,$$

wherein:

R is selected from saturated and mono-unsaturated C10 to C26 linear or branched alkyl chains, preferably from C12 to C24 linear or branched alkyl chains, more preferably from C16 to C20 linear alkyl chain;

n is selected from 5 to 20, preferably from 7 to 13, more preferably from 8 to 12, most preferably from 9.5 to 10.5; and, (iii) a lipid esterase at a level of from 0.0005 to 0.5 wt % of pure enzyme, preferably 0.005 to 0.2 wt %.

In another aspect the present invention provides a domestic method of treating a textile, the method comprising the step of: treating a textile with an aqueous solution of 0.5 to 20 g/L of the laundry detergent composition as defined herein.

DETAILED DESCRIPTION OF THE INVENTION

Alkyl Ether Carboxylic Acid

In the context of the current invention alkyl ether carboxylic acid dispersants are not included as anionic surfactants. Weights of alkyl ether carboxylic acid are calculated as the protonated form, $R—(OCH_2CH_2)_n—OCH_2COOH$. They may be used as salt version for example sodium salt, or amine salt.

The alkyl chain may be linear or branched, preferably it is linear.

The alkyl chain may be aliphatic or contain one cis-double bond. Preferred examples of aliphatic linear chains are $CH_3(CH_2)_{13}$, $CH_3(CH_2)_{15}$, $CH_3(CH_2)_{17}$, and $CH_3(CH_2)_{19}$.

The alkyl chain is most preferably $CH_3(CH_2)_7CH{=}CH(CH_2)_8—$.

The alkyl ether carboxylic acid is most preferably of the structure:

$$CH_3(CH_2)_7CH{=}CH(CH_2)_8(OCH_2CH_2)_{10}OCH_2COOH.$$

Alkyl ether carboxylic acid are available from Kao (Akypo®), Huntsman (Empicol®) and Clariant (Emulsogen®).

Lipid Esterases

Cleaning lipid esterases are discussed in Enzymes in Detergency edited by Jan H. Van Ee, Onno Misset and Erik J. Baas (1997 Marcel Dekker, New York).

Cleaning lipid esterases are preferable active at alkaline pH in the range 7 to 11, most preferably they have maximum activity in the pH range 8 to 10.5.

The lipid esterase may be selected from lipase enzymes in E.C. class 3.1 or 3.2 or a combination thereof.

Preferably the cleaning lipid esterases is selected from (1) *Triacylglycerol* lipases (E.C. 3.1.1.3)

(2) Carboxylic ester hydrolase (E.C. 3.1.1.1)

(3) Cutinase (E.C. 3.1.1.74)

(4) Sterol esterase (E.C. 3.1.1.13)

(5) Wax-ester hydrolase (E.C. 3.1.1.50)

Suitable triacylglycerol lipases can be selected from variants of the *Humicola lanuginosa* (*Thermomyces lanuginosus*) lipase. Other suitable triacylglycerol lipases can be selected from variants of *Pseudomonas* lipases, e.g., from *P. alcaligenes or P. pseudoalcaligenes* (EP 218 272), *P. cepacia* (EP 331 376), *P. stutzeri* (GB 1,372,034), *P. fluorescens, Pseudomonas* sp. strain SD 705 (WO 95/06720 and WO 96/27002), *P. wisconsinensis* (WO 96/12012), *Bacillus* lipases, e.g., from *B. subtilis* (Dartois et al. (1993), Biochemica et Biophysica Acta, 1131, 253-360), *B. stearothermophilus* (JP 64/744992) or *B. pumilus* (WO 91/16422).

Suitable carboxylic ester hydrolases can be selected from wild-types or variants of carboxylic ester hydrolases endogenous to *B. gladioli, P. fluorescens, P. putida, B. acidocaldarius, B. subtilis, B. stearothermophilus, Streptomyces chrysomallus, S. diastatochromogenes* and *Saccaromyces cerevisiae.*

Suitable cutinases can be selected from wild-types or variants of cutinases endogenous to strains of *Aspergillus*, in particular *Aspergillus oryzae*, a strain of *Alternaria*, in particular *Alternaria brassiciola*, a strain of *Fusarium*, in particular *Fusarium solani, Fusarium solani pisi, Fusarium oxysporum, Fusarium oxysporum cepa, Fusarium roseum culmorum*, or *Fusarium roseum sambucium*, a strain of *Helminthosporum*, in particular *Helminthosporum sativum*, a strain of *Humicola*, in particular *Humicola insolens*, a strain of *Pseudomonas*, in particular *Pseudomonas mendocina*, or *Pseudomonas putida*, a strain of *Rhizoctonia*, in particular *Rhizoctonia solani*, a strain of *Streptomyces*, in particular *Streptomyces scabies*, a strain of *Coprinopsis*, in particular *Coprinopsis cinerea*, a strain of *Thermobifida*, in particular *Thermobifida fusca*, a strain of *Magnaporthe*, in particular *Magnaporthe grisea*, or a strain of *Ulocladium*, in particular *Ulocladium consortiale.*

In a preferred embodiment, the cutinase is selected from variants of the *Pseudomonas mendocina* cutinase described in WO 2003/076580 (Genencor), such as the variant with three substitutions at 1178M, F180V, and S205G.

In another preferred embodiment, the cutinase is a wild-type or variant of the six cutinases endogenous to *Coprinopsis cinerea* described in H. Kontkanen et al, App. Environ. Microbiology, 2009, p 2148-2157

In another preferred embodiment, the cutinase is a wild-type or variant of the two cutinases endogenous to *Trichoderma reesei* described in WO2009007510 (VTT).

In a most preferred embodiment the cutinase is derived from a strain of *Humicola insolens*, in particular the strain *Humicola insolens* DSM 1800. *Humicola insolens* cutinase is described in WO 96/13580 which is hereby incorporated by reference. The cutinase may be a variant, such as one of the variants disclosed in WO 00/34450 and WO 01/92502. Preferred cutinase variants include variants listed in Example 2 of WO 01/92502. Preferred commercial cutinases include Novozym 51032 (available from Novozymes, Bagsvaerd, Denmark).

Suitable sterol esterases may be derived from a strain of *Ophiostoma*, for example *Ophiostoma piceae*, a strain of *Pseudomonas*, for example *Pseudomonas aeruginosa*, or a strain of *Melanocarpus*, for example *Melanocarpus albomyces.*

In a most preferred embodiment the sterol esterase is the *Melanocarpus albomyces* sterol esterase described in H. Kontkanen et al, Enzyme Microb Technol., 39, (2006), 265-273.

Suitable wax-ester hydrolases may be derived from *Simmondsia chinensis.*

The lipid esterase is most preferably selected from a *Triacylglycerol* lipases (E.C. 3.1.1.3).

Examples of EC 3.1.1.3 lipases include those described in WIPO publications WO 00/60063, WO 99/42566, WO 02/062973, WO 97/04078, WO 97/04079 and U.S. Pat. No. 5,869,438. Preferred lipases are produced by *Absidia reflexa, Absidia corymbefera, Rhizmucor miehei, Rhizopus deleman Aspergillus niger, Aspergillus tubigensis, Fusarjum oxysporum, Fusarium heterosporum, Aspergillus oryzea, Penicilium camembertii, Aspergillus foetidus, Aspergillus niger, Thermomyces lanoginosus* (synonym: *Humicola lanuginosa*) and *Landerina penisapora*, particularly *Thermomyces lanoginosus*. Certain preferred lipases are supplied by Novozymes under the tradenames. Lipolase®, Lipolase Ultra®, Lipoprime®, Lipoclean® and Lipex® (registered tradenames of Novozymes) and LIPASE P "AMANO®" available from Areario Pharmaceutical Co. Ltd., Nagoya, Japan, AMANO-CES®, commercially available from Toyo Jozo Co., Tagata, Japan; and further *Chromobacter viscosum* lipases from Amersham Pharmacia Biotech., Piscataway, N.J., U.S.A. and Diosynth Co., Netherlands, and other lipases such as *Pseudomonas gladioli*. Additional useful lipases are described in WIPO publications WO 02062973, WO 2004/101759, WO 2004/101760 and WO 2004/101763. In one embodiment, suitable lipases include the "first cycle lipases" described in WO 00/60063 and U.S. Pat. No. 6,939,702 BI, preferably a variant of SEQ ID No. 2, more preferably a variant of SEQ ID No. 2 having at least 90% homology to SEQ ID No. 2 comprising a substitution of an electrically neutral or negatively charged amino acid with R or K at any of positions 3, 224, 229, 231 and 233, with a most preferred variant comprising T23 IR and N233R mutations, such most preferred variant being sold under the tradename Lipex® (Novozymes).

The aforementioned lipases can be used in combination (any mixture of lipases can be used). Suitable lipases can be purchased from Novozymes, Bagsvaerd, Denmark; Areario Pharmaceutical Co. Ltd., Nagoya, Japan; Toyo Jozo Co., Tagata, Japan; Amersham Pharmacia Biotech., Piscataway, N.J., U.S.A; Diosynth Co., Oss, Netherlands and/or made in accordance with the examples contained herein.

Lipid esterase with with reduced potential for odor generation and a good relative performance, are particularly preferred, as described in WO2007/087243. These include Lipoclean® (Novozyme).

Surfactant

The laundry composition comprises an anionic charged surfactant (which includes a mixture of the same).

Preferably the weight fraction of non-ionic surfactant/anionic surfactant is from 0 to 0.3, preferably 0 to 0.1.

Suitable anionic detergent compounds which may be used are usually water-soluble alkali metal salts of organic sulphates and sulphonates having alkyl radicals containing from about 8 to about 22 carbon atoms, the term alkyl being used to include the alkyl portion of higher alkyl radicals.

Examples of suitable synthetic anionic detergent compounds are sodium and potassium alkyl sulphates, especially those obtained by sulphating higher $C_8$ to $C_{18}$ alcohols, produced for example from tallow or coconut oil, sodium and potassium alkyl $C_9$ to $C_{29}$ benzene sulphonates, particularly sodium linear secondary alkyl $C_{10}$ to $C_{15}$ benzene sulphonates; and sodium alkyl glyceryl ether sulphates, especially those ethers of the higher alcohols derived from tallow or coconut oil and synthetic alcohols derived from petroleum.

The anionic surfactant is preferably selected from: linear alkyl benzene sulphonate; alkyl sulphates; alkyl ether sulphates; soaps; alkyl (preferably methyl) ester sulphonates, and mixtures thereof.

The most preferred anionic surfactants are selected from: linear alkyl benzene sulphonate; alkyl sulphates; alkyl ether sulphates and mixtures thereof. Preferably the alkyl ether sulphate is a $C_{12}$-$C_{14}$ n-alkyl ether sulphate with an average of 1 to 3EO (ethoxylate) units. Sodium lauryl ether sulphate is particularly preferred (SLES). Preferably the linear alkyl benzene sulphonate is a sodium $C_{11}$ to $C_{15}$ alkyl benzene sulphonates. Preferably the alkyl sulphates is a linear or branched sodium $C_{12}$ to $C_{18}$ alkyl sulphates. Sodium dodecyl sulphate is particularly preferred, (SDS, also known as primary alkyl sulphate).

In liquid formulations preferably two or more anionic surfactant are present, for example linear alkyl benzene sulphonate together with an alkyl ether sulphate.

In liquid formulations, preferably the laundry composition in addition to the anionic surfactant comprises an alkyl ethoylated non-ionic surfactant, preferably at a level from 2 to 8 wt %.

Suitable nonionic detergent compounds which may be used include, in particular, the reaction products of compounds having an aliphatic hydrophobic group and a reactive hydrogen atom, for example, aliphatic alcohols, acids or amides, especially ethylene oxide either alone or with propylene oxide. Specific nonionic detergent compounds are the condensation products of aliphatic $C_8$ to C18 primary or secondary linear or branched alcohols with ethylene oxide.

Preferably the alkyl ethoxylated non-ionic surfactant is a $C_8$ to $C_{18}$ primary alcohol with an average ethoxylation of 7EO to 9EO units.

The nonionic and anionic surfactants of the surfactant system may be chosen from the surfactants described "Surface Active Agents" Vol. 1, by Schwartz & Perry, Interscience 1949, Vol. 2 by Schwartz, Perry & Berch, Interscience 1958, in the current edition of "McCutcheon's Emulsifiers and Detergents" published by Manufacturing Confectioners Company or in "Tenside-Taschenbuch", H. Stache, 2nd Edn., Carl Hauser Verlag, 1981.

Preferably the surfactants used are saturated.

Also applicable are surfactants such as those described in EP-A-328 177 (Unilever), which show resistance to salting-out, the alkyl polyglycoside surfactants described in EP-A-070 074, and alkyl monoglycosides.

The detergent compositions based on anionic or anionic/non-ionic surfactants is however the more preferred embodiment.

Builders or Complexing Agents

Builder materials may be selected from 1) calcium sequestrant materials, 2) precipitating materials, 3) calcium ion-exchange materials and 4) mixtures thereof.

Examples of calcium sequestrant builder materials include alkali metal polyphosphates, such as sodium tripolyphosphate and organic sequestrants, such as ethylene diamine tetra-acetic acid.

Examples of precipitating builder materials include sodium orthophosphate and sodium carbonate.

Examples of calcium ion-exchange builder materials include the various types of water-insoluble crystalline or amorphous aluminosilicates, of which zeolites are the well-known representatives, e.g. zeolite A, zeolite B (also known as zeolite P), zeolite C, zeolite X, zeolite Y and also the zeolite P-type as described in EP-A-0,384,070.

The composition may also contain 0-65% of a builder or complexing agent such as ethylenediaminetetraacetic acid, diethylenetriamine-pentaacetic acid, alkyl- or alkenylsuccinic acid, nitrilotriacetic acid or the other builders mentioned below. Many builders are also bleach-stabilising agents by virtue of their ability to complex metal ions.

Zeolite and carbonate (carbonate (including bicarbonate and sesquicarbonate) are preferred builders, with carbonates being particularly preferred.

The composition may contain as builder a crystalline aluminosilicate, preferably an alkali metal aluminosilicate, more preferably a sodium aluminosilicate. This is typically present at a level of less than 15% w. Aluminosilicates are materials having the general formula:

$$0.8\text{-}1.5\ M_2O.\ Al_2O_3.\ 0.8\text{-}6\ SiO_2,$$

where M is a monovalent cation, preferably sodium. These materials contain some bound water and are required to have a calcium ion exchange capacity of at least 50 mg CaO/g. The preferred sodium aluminosilicates contain 1.5-3.5 $SiO_2$ units in the formula above. They can be prepared readily by reaction between sodium silicate and sodium aluminate, as amply described in the literature. The ratio of surfactants to alumuminosilicate (where present) is preferably greater than 5:2, more preferably greater than 3:1. Alternatively, or additionally to the aluminosilicate builders, phosphate builders may be used. In this art the term 'phosphate' embraces diphosphate, triphosphate, and phosphonate species. Other forms of builder include silicates, such as soluble silicates, metasilicates, layered silicates (e.g. SKS-6 from Hoechst).

Most preferably the laundry detergent formulation is a non-phosphate built powder laundry detergent formulation, i.e., contains less than 1 wt % of phosphate. Preferably the powder laundry detergent formulations are predominantly carbonate built. Powders, should preferably give an in use pH of from 9.5 to 11. Preferably the powder laundry detergent has linear alkyl benzene sulfonate surfactant at a level of greater than 80 wt % of the total anionic surfactant present.

In the aqueous liquid laundry detergent it is preferred that mono propylene glycol is present at a level from 1 to 30 wt %, most preferably 2 to 18 wt %, to provide the formulation with appropriate, pourable viscosity.

Fluorescent Agent

The composition preferably comprises a fluorescent agent (optical brightener). Fluorescent agents are well known and many such fluorescent agents are available commercially. Usually, these fluorescent agents are supplied and used in the form of their alkali metal salts, for example, the sodium salts.

The total amount of the fluorescent agent or agents used in the composition is generally from 0.0001 to 0.5 wt %, preferably 0.005 to 2 wt %, more preferably 0.01 to 0.1 wt %.

Preferred classes of fluorescer are: Di-styryl biphenyl compounds, e.g. Tinopal (Trade Mark) CBS-X, Di-amine stilbene di-sulphonic acid compounds, e.g. Tinopal DMS pure Xtra and Blankophor (Trade Mark) HRH, and Pyrazoline compounds, e.g. Blankophor SN.

Preferred fluorescers are fluorescers with CAS-No 3426-43-5; CAS-No 35632-99-6; CAS-No 24565-13-7; CAS-No 12224-16-7; CAS-No 13863-31-5; CAS-No 4193-55-9; CAS-No 16090-02-1; CAS-No 133-66-4; CAS-No 68444-86-0; CAS-No 27344-41-8.

Most preferred fluorescers are: sodium 2 (4-styryl-3-sulfophenyl)-2H-napthol[1,2-d]triazole, disodium 4,4'-bis{[(4-anilino-6-(N methyl-N-2 hydroxyethyl) amino 1,3,5-triazin-2-yl)]amino}stilbene-2-2' disulphonate, disodium 4,4'-bis{[(4-anilino-6-morpholino-1,3,5-triazin-2-yl)]amino}stilbene-2-2' disulphonate, and disodium 4,4'-bis(2-sulphostyryl)biphenyl.

The aqueous solution used in the method has a fluorescer present. The fluorescer is present in the aqueous solution used in the method preferably in the range from 0.0001 g/l to 0.1 g/l, more preferably 0.001 to 0.02 g/l.

Perfume

The composition preferably comprises a perfume. Many suitable examples of perfumes are provided in the CTFA (Cosmetic, Toiletry and Fragrance Association) 1992 International Buyers Guide, published by CFTA Publications and OPD 1993 Chemicals Buyers Directory 80th Annual Edition, published by Schnell Publishing Co.

Preferably the perfume comprises at least one note (compound) from: alpha-isomethyl ionone, benzyl salicylate; citronellol; coumarin; hexyl cinnamal; linalool; pentanoic acid, 2-methyl-, ethyl ester; octanal; benzyl acetate; 1,6-octadien-3-ol, 3,7-dimethyl-, 3-acetate; cyclohexanol, 2-(1,1-dimethylethyl)-, 1-acetate; delta-damascone; beta-ionone; verdyl acetate; dodecanal; hexyl cinnamic aldehyde; cyclopentadecanolide; benzeneacetic acid, 2-phenylethyl ester; amyl salicylate; beta-caryophyllene; ethyl undecylenate; geranyl anthranilate; alpha-irone; beta-phenyl ethyl benzoate; alpa-santalol; cedrol; cedryl acetate;

cedry formate; cyclohexyl salicyate; gamma-dodecalactone; and, beta phenylethyl phenyl acetate.

Useful components of the perfume include materials of both natural and synthetic origin. They include single compounds and mixtures. Specific examples of such components may be found in the current literature, e.g., in Fenaroli's Handbook of Flavor Ingredients, 1975, CRC Press; Synthetic Food Adjuncts, 1947 by M. B. Jacobs, edited by Van Nostrand; or Perfume and Flavor Chemicals by S. Arctander 1969, Montclair, N.J. (USA).

It is commonplace for a plurality of perfume components to be present in a formulation. In the compositions of the present invention it is envisaged that there will be four or more, preferably five or more, more preferably six or more or even seven or more different perfume components.

In perfume mixtures preferably 15 to 25 wt % are top notes. Top notes are defined by Poucher (Journal of the Society of Cosmetic Chemists 6(2):80 [1955]). Preferred top-notes are selected from citrus oils, linalool, linalyl acetate, lavender, dihydromyrcenol, rose oxide and cis-3-hexanol.

The International Fragrance Association has published a list of fragrance ingredients (perfumes) in 2011. (http://www.ifraorq.orq/en-us/ingredients#.U7Z4hPldWzk).

The Research Institute for Fragrance Materials provides a database of perfumes (fragrances) with safety information.

Perfume top note may be used to cue the whiteness and brightness benefit of the invention.

Some or all of the perfume may be encapsulated, typical perfume components which it is advantageous to encapsulate, include those with a relatively low boiling point, preferably those with a boiling point of less than 300, preferably 100-250 Celsius. It is also advantageous to encapsulate perfume components which have a low CLog P (ie. those which will have a greater tendency to be partitioned into water), preferably with a CLog P of less than 3.0. These materials, of relatively low boiling point and relatively low CLog P have been called the "delayed blooming" perfume ingredients and include one or more of the following materials: allyl caproate, amyl acetate, amyl propionate, anisic aldehyde, anisole, benzaldehyde, benzyl acetate, benzyl acetone, benzyl alcohol, benzyl formate, benzyl iso valerate, benzyl propionate, beta gamma hexenol, camphor gum, laevo-carvone, d-carvone, cinnamic alcohol, cinamyl formate, cis-jasmone, cis-3-hexenyl acetate, cuminic alcohol, cyclel c, dimethyl benzyl carbinol, dimethyl benzyl carbinol acetate, ethyl acetate, ethyl aceto acetate, ethyl amyl ketone, ethyl benzoate, ethyl butyrate, ethyl hexyl ketone, ethyl phenyl acetate, eucalyptol, eugenol, fenchyl acetate, flor acetate (tricyclo decenyl acetate), frutene (tricycico decenyl propionate), geraniol, hexenol, hexenyl acetate, hexyl acetate, hexyl formate, hydratropic alcohol, hydroxycitronellal, indone, isoamyl alcohol, iso menthone, isopulegyl acetate, isoquinolone, ligustral, linalool, linalool oxide, linalyl formate, menthone, menthyl acetphenone, methyl amyl ketone, methyl anthranilate, methyl benzoate, methyl benyl acetate, methyl eugenol, methyl heptenone, methyl heptine carbonate, methyl heptyl ketone, methyl hexyl ketone, methyl phenyl carbinyl acetate, methyl salicylate, methyl-n-methyl anthranilate, nerol, octalactone, octyl alcohol, p-cresol, p-cresol methyl ether, p-methoxy acetophenone, p-methyl acetophenone, phenoxy ethanol, phenyl acetaldehyde, phenyl ethyl acetate, phenyl ethyl alcohol, phenyl ethyl dimethyl carbinol, prenyl acetate, propyl bornate, pulegone, rose oxide, safrole, 4-terpinenol, alpha-terpinenol, and/or viridine. It is commonplace for a plurality of perfume components to be present in a formulation. In the compositions of the present invention it is envisaged that there will be four or more, preferably five or more, more preferably six or more or even seven or more different perfume components from the list given of delayed blooming perfumes given above present in the perfume.

Another group of perfumes with which the present invention can be applied are the so-called 'aromatherapy' materials. These include many components also used in perfumery, including components of essential oils such as Clary Sage, Eucalyptus, Geranium, Lavender, Mace Extract, Neroli, Nutmeg, Spearmint, Sweet Violet Leaf and Valerian.

It is preferred that the laundry treatment composition does not contain a peroxygen bleach, e.g., sodium percarbonate, sodium perborate, and peracid.

Polymers

The composition may comprise one or more further polymers. Examples are carboxymethylcellulose, poly (ethylene glycol), poly(vinyl alcohol), polycarboxylates such as polyacrylates, maleic/acrylic acid copolymers and lauryl methacrylate/acrylic acid copolymers.

Where alkyl groups are sufficiently long to form branched or cyclic chains, the alkyl groups encompass branched, cyclic and linear alkyl chains. The alkyl groups are preferably linear or branched, most preferably linear.

The indefinite article "a" or "an" and its corresponding definite article "the" as used herein means at least one, or one or more, unless specified otherwise.

Dye weights refer to the sodium or chloride salts unless otherwise stated.

EXPERIMENTAL EXAMPLES

A powder laundry detergent was prepared of the following formulation:

| Ingredient | Weight % |
|---|---|
| Linear alkyl benzene sulfonate | 14.5 |
| Sodium carbonate | 20.0 |
| Sodium sulphate | 50.0 |
| Sodium silicate | 6.0 |
| zeolite | 2.5 |
| Salt speckle granules (blue and red) | 1.8 |
| perfume | 0.3 |
| Sodium carboxymethylcellulose | 0.1 |
| Sokalan CPS (ex BASF) | 0.1 |
| Minors (including fluorescer shading dye with CAS-No 72749-80-5 and CAS-No 81-42-5) and moisture | to 100% |

The formulation was used to wash eight 5×5 cm EMPA 117 stain monitor (blood/milk/ink stain on polycotton) in a tergotometer set at 200 rpm. A 60 minute wash was conducted in 800 ml of 26° French Hard water at 35° C., with 1.5 g/L of the formulation. To simulate oily soil (7.4 g) of an SBL2004 soil strip (ex Warwick Equest) was added to the wash liquor.

Once the wash had been completed the cotton monitors were rinsed once in 400 ml clean water, removed dried and the colour measured on a reflectometer and expressed as the CIE L*a*b* values.

Equivalent Formulations but with the addition of 13.3 wt % alkyl ether carboxylic acid, wherein the alkyl group was cis-9-octadecene, were tested. The average number of ethoxy groups was varied from 2 to 10.

Experiments were repeated with and without the addition of a lipid esterase enzyme (*Triacylglycerol* lipase: EC no. 3.1.1.3) to the wash liquor. (Lipex® ex Novozymes). The enzyme was added to give 0.3 wt % pure active protein to the formulation.

95% confidence limits are also given calculated from the standard deviation on the measurements from the 8 monitors.

| | Without lipase reference | | With lipase | |
|---|---|---|---|---|
| | L* | 95% | L* | 95% |
| Control | 58.7 | 0.4 | 59.4 | 0.3 |
| 2EO reference | 56.3 | 0.4 | 59.4 | 0.4 |
| 5EO | 58.8 | 0.2 | 63.0 | 0.3 |
| 10EO | 59.6 | 0.3 | 64.6 | 0.2 |

The combination of lipase and alkyl ether carboxylic acid with 5 and 10EO to the formulation increases the stain removal as seen by higher L* values compared to the reference control values. The combination of lipase and alkyl ether carboxylic acid with 5EO, and 10EO gives a greater increase in stain removal than expected from combination of the effects of the single components. For 5EO/lipase an L* value of 59.5 is expected and 63.0 obtained. For 10EO/lipase a value of 60.3 is expected and 64.6 obtained.

The formulation was remade with the addition of mix of amylase, mannase and pectinase enzymes (Stainzyme® Novozyme, Mannaway® Novozymes, Pectawash® Novozymes).

The invention claimed is:

1. A laundry detergent composition comprising:

(i) from 4 to 50 wt % linear alkyl benzene sulphonate;

(ii) from 0.5 to 20 wt % of an alkyl ether carboxylic add dispersant of the following structure: $CH_3(CH_2)_7CH{=}CH(CH_2)_8(OCH_2CH_2)_{10}OCH_2COOH$; and (iii) a lipid esterase at a level of from 0.0005 to 0.5 wt % of pure enzyme.

2. A laundry detergent composition according to claim 1 wherein the lipid esterase is selected from *Triacylglycerol* lipase (E.C. 3.1.1.3); Carboxylic ester hydrolase (E.C. 3.1.1.1); Cutinase (E.C. 3.1.1.74); Sterol esterase (E.C. 3.1.1.13); Wax-ester hydrolase (E.C. 3.1.1.50).

3. A laundry detergent composition according to claim 1 where the lipid esterase is a *Triacylglycerol* lipases (E.C. 3.1.1.3).

4. A laundry detergent composition according to claim 1, wherein the composition is a non-phosphate built powder laundry detergent formulation.

5. A laundry detergent composition according to claim 1, wherein the lipid esterase is present at a level of from 0.005 to 0.2 wt % of pure enzyme.

6. A laundry detergent composition according to claim 1 wherein the level of linear alkyl benzene sulphonate is from 8 to 20 wt %.

7. A laundry detergent composition according to claim 1 further comprising a non-ionic surfactant.

8. A domestic method of treating a textile, the method comprising the step of: treating a textile with an aqueous solution of 0.5 to 20 g/L of the laundry detergent composition according to claim 1.

9. A laundry detergent composition according to claim 7 comprising a weight fraction of non-ionic surfactant/anionic surfactant of up to 0.3.

* * * * *